United States Patent [19]

Herigstad et al.

[11] Patent Number: 5,044,862

[45] Date of Patent: Sep. 3, 1991

[54] TRANSFER TABLE CLAM SHELL LINKAGE AND METHOD OF TRANSFERRING A ROLL TO A REEL STAND

[75] Inventors: David P. Herigstad, Aberdeen; James D. Terry, Edmonds, both of Wash.

[73] Assignee: Haines & Emerson, Inc., Hoquiam, Wash.

[21] Appl. No.: 444,645

[22] Filed: Nov. 29, 1989

[51] Int. Cl.[5] ..... B65G 67/24

[52] U.S. Cl. ..... 414/392; 242/58.6; 242/79; 414/347; 414/399; 414/911

[58] Field of Search ..... 414/391, 911, 498, 392, 414/393, 399, 347, 495; 254/9 R, 9 C, 124; 198/468.6, 468.8; 242/58.6, 79

[56] References Cited

U.S. PATENT DOCUMENTS

| | | | |
|---|---|---|---|
| 328,828 | 10/1885 | Way | 414/391 |
| 1,448,311 | 3/1923 | Miller | 414/391 |
| 3,552,556 | 1/1971 | Hall | 414/495 |
| 4,131,206 | 12/1978 | Kawada et al. | 414/391 X |
| 4,492,503 | 1/1985 | Thomas et al. | 198/468.8 X |
| 4,854,806 | 8/1989 | Gertsch et al. | 414/495 |
| 4,863,395 | 9/1989 | Herigstad et al. | 414/911 X |
| 4,934,511 | 6/1990 | Wood, III et al. | 198/468.6 X |
| 4,971,508 | 11/1990 | Miyahara et al. | 414/911 X |

OTHER PUBLICATIONS

FMC, Picture of Roll Handling Equipment, approx. 1988.

Mfgr. possibly Mitsubishi, Pictures of Roll Handling Equipment Used in Japan, 1988.

Portec, Pictures of Roll Handling Equipment, approx. 1988.

Jervis B. Webb Co., Advertisement, *Presstime*, p. 2, July 1987.

IDAB Inc., Brochure Entitled, "Product Brief", June 1988.

FMC, article entitled, "FMC's Automated Guided Vehicle (AGV) System", *Newspapers & Technology*, p. 21, Aug. 1989.

*Primary Examiner*—David A. Bucci

*Attorney, Agent, or Firm*—Seed and Berry

[57] ABSTRACT

The invention involves a method of and apparatus for transferring rolls of various sizes from a roll delivery vehicle to a spindle of a reel stand. A transfer table with articulated arms lifts the roll off of the vehicle and aligns the roll both in the vertical and horizontal directions so that the longitudinal axis of the roll coincides with the axis of the spindle. A unique clam shell linkage of the articulated arms allows the transfer table to handle different diameter rolls and position the different diameter rolls on spindles of different heights.

6 Claims, 6 Drawing Sheets

TRANSFER TABLE CLAM SHELL LINKAGE AND METHOD OF TRANSFERRING A ROLL TO A REEL STAND

DESCRIPTION

1. Technical Field

The invention relates to systems for handling rolls. More specifically, the invention relates to a method of and an apparatus for transferring rolls of varying diameters from a delivery vehicle to spindles of a reel stand of a printing press.

2. Background of the Invention

Generally, printing presses require rolls of paper in large quantities. The rolls of paper are commonly stored on a reel stand with multiple spindles for holding several rolls. These rolls must be replaced continually so that the printing press can continue without interruption. Rolls stored in warehouses are brought to the reel stand area, by an automatic guided vehicle (AGV) cart or other vehicle, and transferred to the spindles of the reel stand. A transfer table or other loading device usually performs the task of loading the rolls on the reel stands.

Various processes of transporting rolls from a storage area and placing the rolls on a reel stand are described in U.S. Pat. No. 4,863,335, which is incorporated in its entirety by reference into the present application. U.S. Pat. No. 4,863,335 involves transferring the rolls by an AGV cart to a transfer table near the reel stand, which places the rolls on spindles of the reel stand.

A disadvantage of the system described in U.S. Pat. No. 4,863,335 is that only rolls of a single diameter can be handled by the transfer table. For each different roll diameter, a special clamshell of the transfer table would have to be designed to enable the transfer table to receive the roll from an AGV cart designed to carry the same diameter of roll, and place the roll at the spindle location. Different clam shells are, of course, expensive to manufacture and require separate machinery for each roll size handled by the system.

Another problem with other systems, including the system of U.S. Pat. No. 4,863,335, is that the printing presses come in various sizes, both in length and diameter. Accordingly, the printing presses have different heights above the ground at which the spindles are located. Under roll transfer systems previously used, spindles have been required to be located at a fixed height so that the transfer table could take the roll from the delivery vehicle at approximately the same height and transfer the roll to the spindles.

In U.S. Pat. No. 4,863,335, the height at which the spindle must be located by the machine is dictated by the height of the AGV cart itself. Thus, if a printing press has a different spool height than that of the AGV cart, the printing press must either be modified to relocate the spindle height, which would require adjustments in the foundation of the press, or the AGV cart design must be modified to be in agreement with the height of the spindle. For example, the AGV design in U.S. Pat. No. 4,863,335 would require the spindles to be raised as much as 18" off of the floor to accomodate certain roll sizes. Changing the spindle location might create some overhang loads which may be too great to overcome.

SUMMARY OF THE INVENTION

The present invention involves a method for transferring rolls from a delivery vehicle to spindles on a reel stand at various heights, and a unique linkage of a clam shell arm of a transfer table which enables the transfer table to take rolls of various diameters and place the rolls at spindle locations of varying heights.

DETAILED DESCRIPTION OF THE INVENTION

Figure 1:
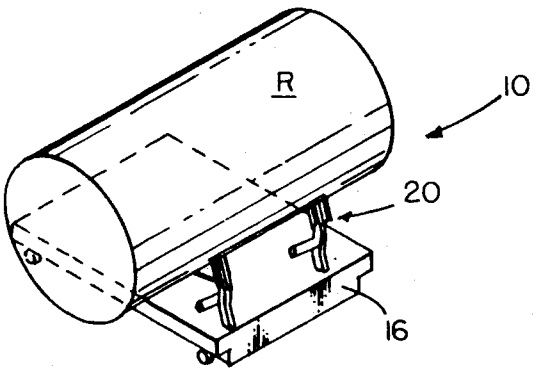
FIG. 1 is a perspective view of the transfer table and clam shell arms supporting one side of a roll.
Figure 2:
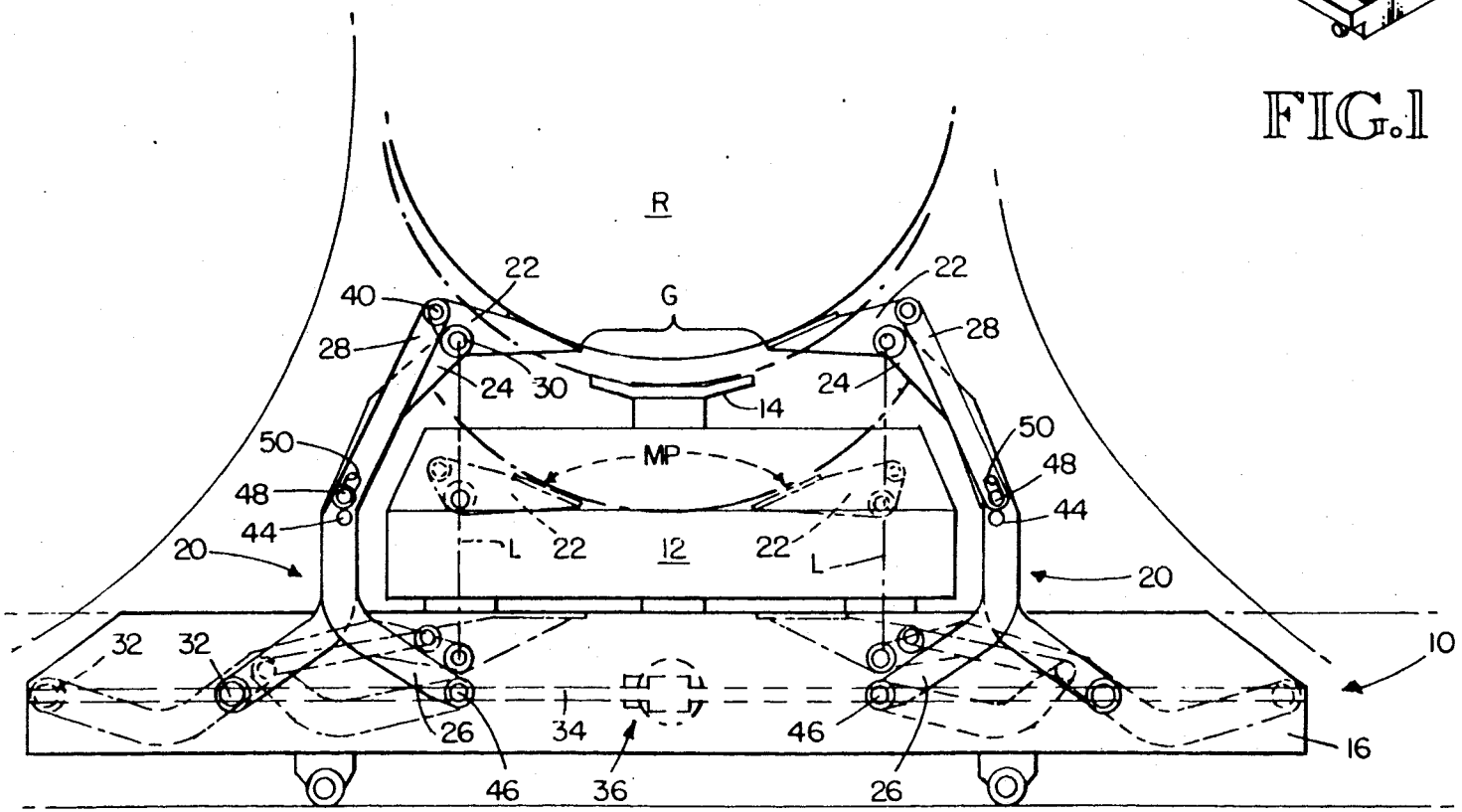
FIG. 2 is a side elevation view of the transfer table including the clam shell linkage.

As best shown in Figures and 2, a transfer table 10 is used to take a roll R from a vehicle, such as an automatic guided vehicle (AGV) cart 12 as shown in FIG. 2, and position the roll at the spindle inserting position of a reel stand which feeds paper to a printing press. The transfer table has a pair of articulated clam shell arms 20 which are raised to lift the roll from a cradle 14 of the AGV cart.

After the roll has been lifted from the AGV cart 12, the cart will proceed either in a forward or backward direction away from the transfer table 10. The transfer table will then move transversely and position the roll to coincide with the axis of a spindle 72. After the spindle has been chucked, the transfer table will lower the clam shell arms 20 and return to receive another roll.

Figure 3:
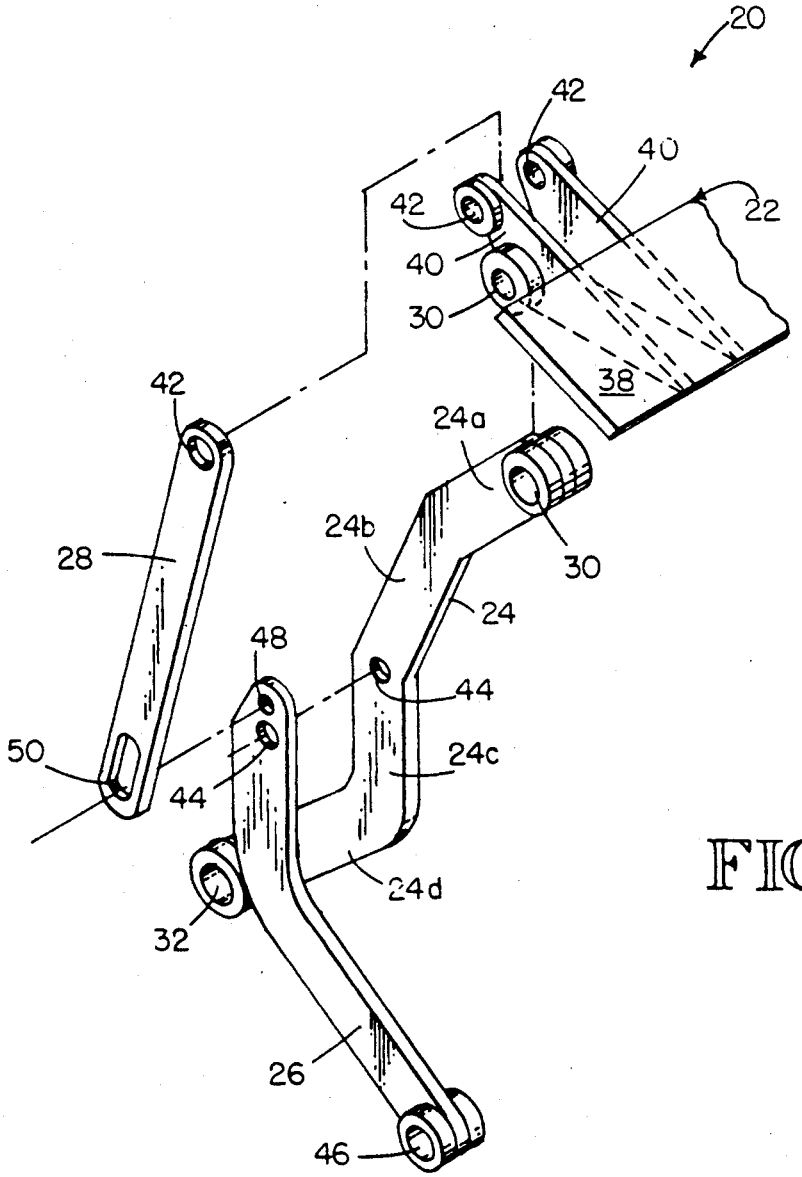
FIG. 3 is an exploded isometric view of the clam shell linkage.

As best shown in FIG. 3, one embodiment of the clam shell arms 20 includes a support pad 22, a main support member 24 coupled to the support pad, a pivot member 26 pivotally connected to the middle portion of the main support member, and a support pad positioning member 28 coupled to both the support pad and the pivot member. The members of the clam shell arms are collectively referred to as the clam shell linkage.

The main support member 24 is coupled at its upper end to the support pad 22 at a pivotal connection point 30, and coupled at its lower end at a pivot point 32 attached to an actuator arm 34 of an actuator 36. In one embodiment, the main support member comprises an S-shaped form, as shown in FIG. 3. Segments **24*a* and 24*b* form the upper portion of the S-shaped main support member and are necessary to allow clearance of the AGV cart while the clam shell arms 20 support the roll. Segments 24*c* and 24*d* form the lower portion of the S-shaped member and allow the horizontal force of the actuator 36** to be translated into a vertical force to lift and support the roll.

Referring again to FIG. 3, the support pad 22 includes a support surface 38 for engaging the roll. The support surface must have sufficient surface area to provide both a vertical supporting force and a horizontal stabilizing force to the roll. The support pad also includes flange portions 40 which surround the pivotal connection point 30 for pivotally connecting the main support member 24, and which surround pivotal connection point 42 for pivotally connecting the support pad positioning member 28.

The pivot member 26 is coupled at its upper end to a middle portion of the main support member 24 at pivotal connection point 44, and to the transfer table frame 16 at a fixed pivot point 46. The pivot member also includes a connection point 48 for connecting the upper end of the pivot member to the support pad positioning member 28.

The support pad positioning member 28 is connected to the support pad 22 at pivotal connection 42 at its upper end, and its lower end is connected to the pivot member 26 at the connecting point 48. In one embodiment, the lower end of the support pad positioning member includes a slot 50, along which a pin or other connecting member rides to allow the support pad to maintain the same orientation and thus the same contact point on the roll throughout the full vertical adjustment range of the clam shell arms 20.

The slot 50 also ensures that the pivotal connection point 30, where the support pad 22 and the main support member 24 are coupled together, travels in purely vertical line L (shown as a dashed line in FIG. 2) when the clam shell arms 20 are raised to a maximum vertical height (shown in solid lines in FIG. 2) and when they are lowered to a minimum vertical height (shown in phantom in FIG. 2). A medium position MP of the support pads, alone, is shown in phantom in FIG. 2. The vertical adjustment range of the clam shell arms will allow for the positioning of any size diameter roll into alignment with the center axis of an empty spindle. At their lowest vertical height, the clam shell arms remain flush with the surface of the transfer table.

A primary advantage of the unique clam shell linkage is that it allows the transfer table 10 to handle rolls of all size diameters. Thus, the press manufacturers no longer need to restrict the rolls used in the press to a single size diameter, nor do they need to develop a transfer table and roll delivery vehicle for each diameter of roll which is manufactured.

Figure 5:
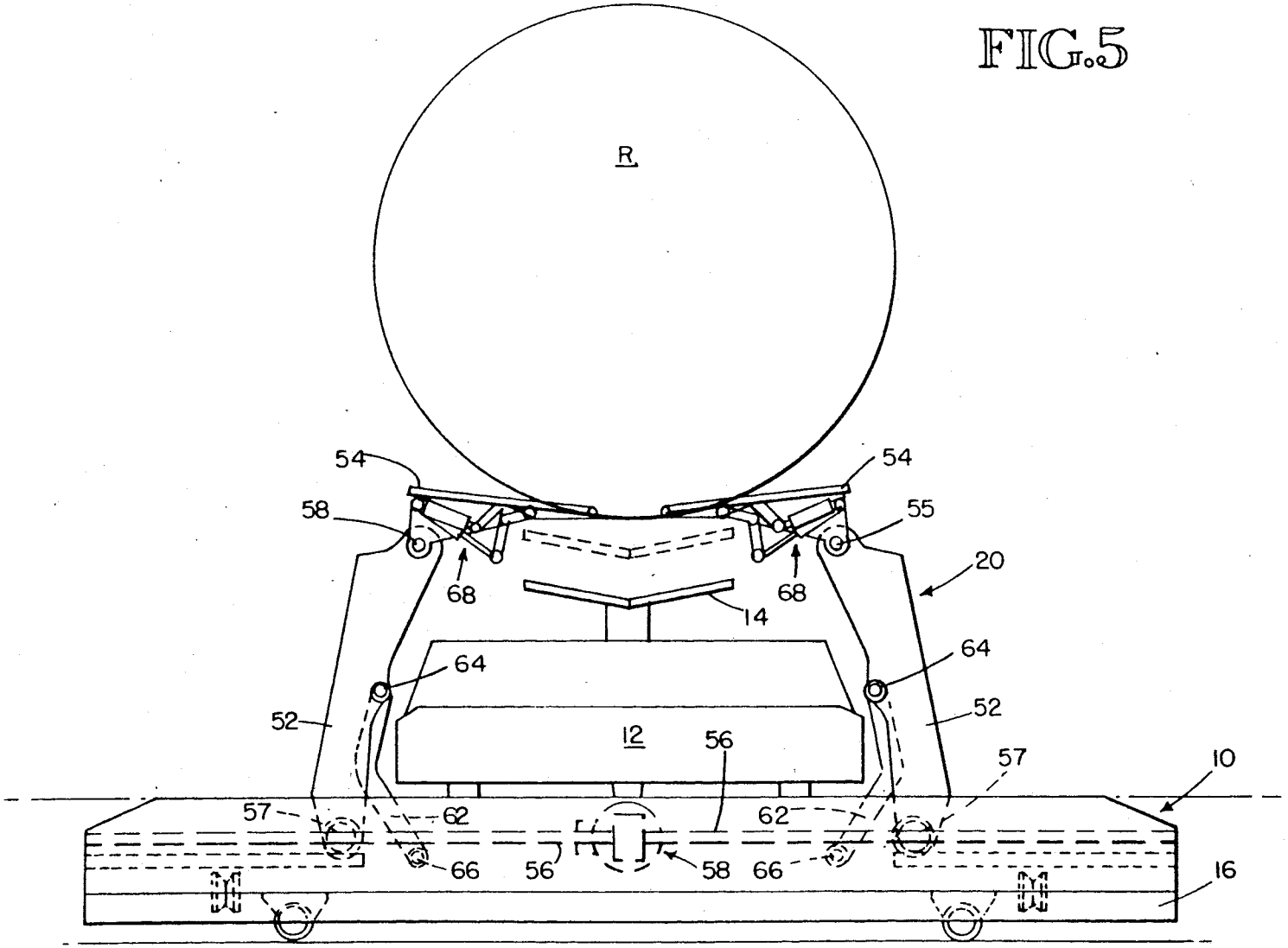
FIG. 5 is a side elevation view of an alternative embodiment of the invention.
Figure 6:
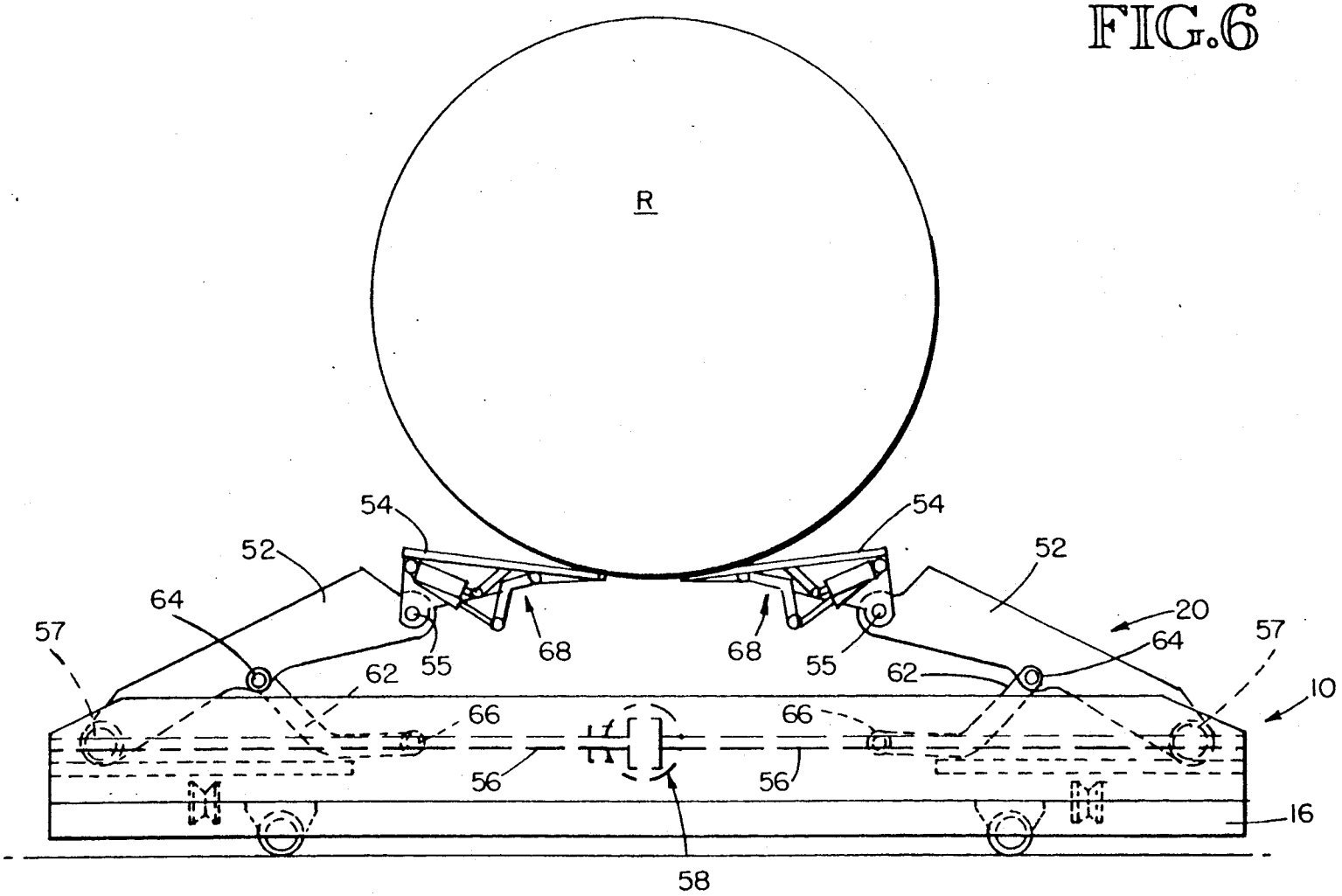
FIG. 6 is a side elevation view of an alternative embodiment of the invention.
Figure 7:
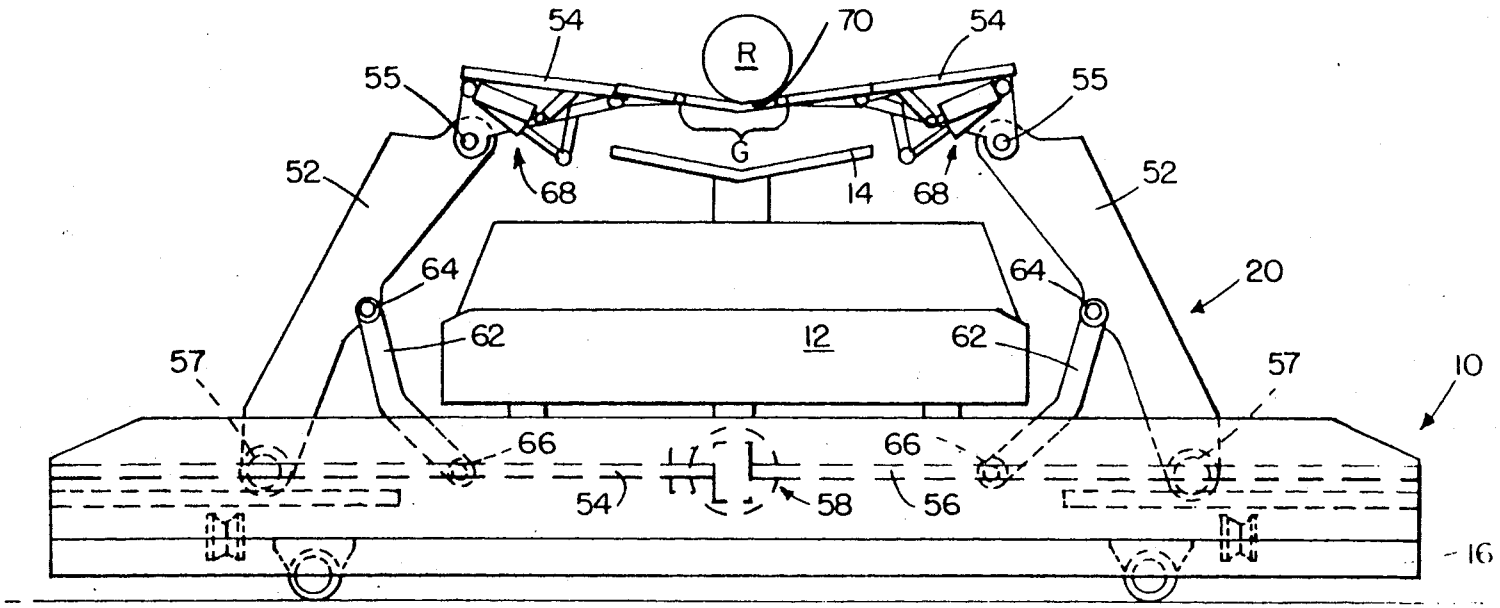
FIG. 7 is a side elevation view of an alternative embodiment of the invention handling a small diameter roll.

An alternative embodiment of the clam shell arms 20 is shown in FIGS. 5, 6, and 7. FIG. 5 shows a clam shell arm 20 having primary support member 52 pivotally coupled to an adjustable support pad 54 at pivot point 55 and pivotally connected at pivot point 57 to a rod 56 of an actuator 58 which moves the bottom portion of the primary support member back and forth horizontally. The actuator could be of any conventional type. A curved pivot member 62 is pivotally connected to the middle portion of the primary support member at pivot point 64 and to a fixed pivot point 66 on the frame 16 of transfer table 10.

As shown in FIG. 5, the clam shell arms 20 lift the roll off of the cradle 14 of the AGV cart 12. Alternatively or in addition to lifting the roll off the cradle, the cradle can be lowered to transfer the weight of the roll to the clam shell arms. After the AGV cart has moved out from under the roll, as shown in FIG. 6, the actuator 58 forces the lower ends of the primary support members 52 outwardly to lower the roll for positioning at the center axis of an empty spindle of a reel stand. The support pads 54 can be adjusted by actuator assemblies 68 to provide the desired positioning of the support pads.

As shown in FIG. 2, between the ends of support pads 22 is a gap G, which, would prevent the transfer table 10 from handling rolls of a diameter smaller than gap G. To solve this problem, a tray 60 or other type of riser is positioned on top of the support pads 22 to bridge the gap G and allow the transfer table to handle smaller diameter rolls, as shown in FIG. 7. Many different types of trays or risers could be used in conjunction with the transfer table. While FIG. 7 involves a different embodiment of the clam shell linkage than the linkage shown in FIG. 2, a tray for handling small diameter rolls is equally useful using the linkage embodiment of FIG. 2.

Accordingly, another primary advantage of the present invention is the ability of the transfer table to handle smaller diameter rolls without any additional equipment other than a tray, which might be the same or different from the tray 60 of FIG. 7, for bridging the gap between the ends of support pads 22. In fact, many press manufacturers already have trays which are suitable for use with the transfer table 10 to handle small diameter rolls and thus would be able to use the present invention in conjunction with the trays they currently use in their businesses.

Figure 4B:
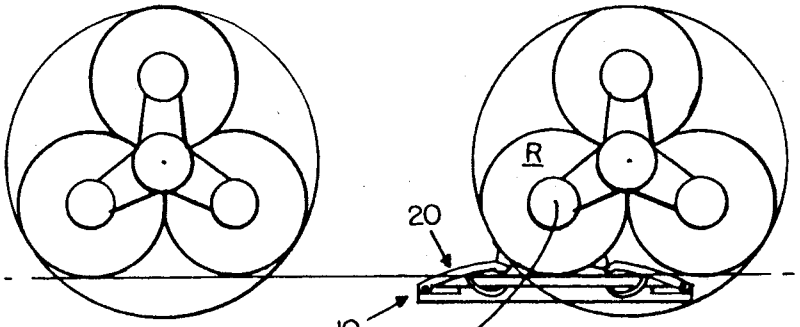
FIGS. 4A, 4B, 4C, and 4D are schematic views of the transfer table positioning a roll on a spindle of a reel stand.
Figure 4D:
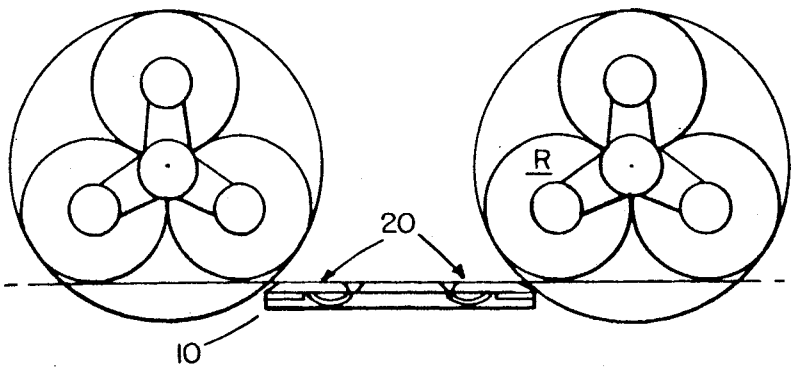
Figure 4A:
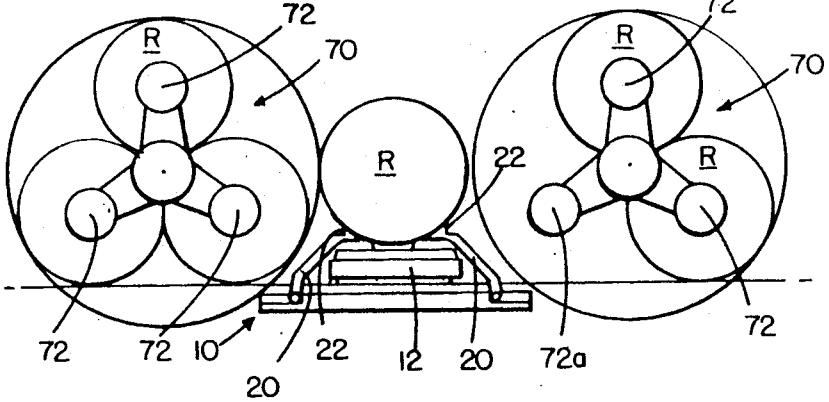

Referring now to FIGS. 4A-4D, a reel stand 70 is shown to have three spindles 72, with one spindle **72*a* having an empty roll which needs replacing. As shown in FIG. 4A, an AGV cart 12 holding a roll moves inside the clam shell arms 20 so that the roll is positioned above the support pads 22 of the clam shell arms. The arms are then raised to lift the roll above the cradle of the AGV cart and transfer the weight of the roll to the arms. Alternatively, or in combination with raising the clam shell arms to lift the roll, the cradle 14** of the AGV cart can be lowered to transfer the weight of the roll to the clam shell arms. This provides an area of clearance between the AGV cradle and bottom of the roll. The AGV then moves out from under the roll, in either the forward or backward direction, and leaves the roll supported on the clam shell arms.

The clam shell arms 20 are then lowered so that bottom of the roll comes within close proximity to the top of the transfer table 10, which places the roll in the lowest possible position for alignment with the spindle **72*a*. It should be understood that the vertical range of the clam shell arms is not to be limited to spindle height shown in FIG. 4A**, but that the vertical adjustment range of the transfer table allows the clam shell arms to handle all sizes of rolls and align the rolls with spindles located at various heights.

The transfer table 10 then moves the roll transversely so that the roll is directly under the spindle **72*a*, and the longitudinal axis of the roll and the axis of the spindle are aligned to be in the same vertical plane, as shown in FIG. 4B**. The clam shell arms are then raised or lowered to vertically align the axis of the roll with the axis of the spindle.

Figure 4C:
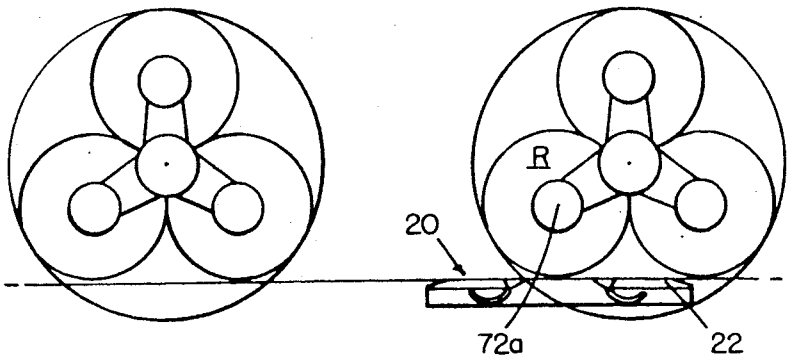

Once the roll is chucked on the spindle **72*a*, as shown in FIG. 4C, the clam shell arms 20 are retracted to provide clearance between the bottom of the roll and the top of the transfer table 10. After the clam shell arms 20 have been lowered, the weight of the roll is supported solely by the spindle. The retracted arms provide clearance between the arms and the bottom of the roll, even when the spindle is located at the lowest possible chuck position, so that the transfer table can be removed from under the roll. When the clam shell arms are retracted to the lowest vertical position, the support pads 22** remain flush with the top of the transfer table.

With the clam shell arms 20 in their retracted position, the transfer table 10 is then moved transversely out from under the roll and returns to the original position ready to receive another roll from an AGV cart 12.

As described above, the invention provides a unique apparatus and method for transferring rolls of varying sizes from a roll delivery vehicle to reel stand spindles located at various heights. While the preferred embodiments of the invention have been illustrated and described, it should be understood that variations will be apparent to one of ordinary skill in the art. Accordingly, the invention is not to be limited to the embodiments illustrated in the drawings.

We claim:

1. A transfer table for positioning rolls of various sizes on a spindle of a reel stand, comprising:

a moveable base frame having a top surface;

a pair of articulated arm means coupled to the base frame opposite each other and moveable upwardly from said top surface for lifting a roll off of a cart and supporting the weight of the roll, the configuration of the arm means allowing the arm means to be lowered to a flat position corresponding to the top surface of the moveable base frame so the cart can pass over the moveable base frame top surface or raised to an extended position so the cart can pass between the arm means and the arms can lift the roll off of the cart; and means for moving the arm means vertically to maintain contact between each arm means and the roll at a fixed location on the roll throughout a full vertical adjustment range of the articulated arm means so that a point on each arm means always travels in a vertical path.

2. A transfer table according to claim 1 wherein means for moving comprises a clam shell linkage which includes a support pad for contacting the roll, and multiple support members pivotally connected to each other, an end of a first support member being coupled to an actuator which provides a force translated through the support members to lift the support the roll.

3. A transfer table according to claim 2, wherein the actuating force is horizontal.

4. A transfer table according to claim 2 wherein the multiple support members comprise a main support member coupled to the support pad, a pivot member pivotally mounted to a fixed position on the base frame at a first end and pivotally mounted to the main support member at a second end, and a support pad positioning member pivotally connected to the support pad and the pivot member, the support pad positioning member maintaining the support pad in a same position when the clam shell arm means are moved in the full vertical adjustment range.

5. The transfer table according to claim 2, wherein the claim shell linkage comprises:

a main support member, a pivot member coupled to the main support member, and a support pad positioning member coupled to the pivot member;

the main support member being pivotally connected at a first end region to the support pad and being pivotally connected to an actuator at a second end region;

the pivot member having a first end region being pivotally connected to a middle region of the main support member, the pivot member also having a connecting member extending from the first end region, a second end region of the pivot member being pivotally coupled to a fixed pivot position;

the support pad positioning member having a first end region pivotally connected to the support pad and a second end region rotatably connected to the pivot member, the support pad positioning member maintaining one contact point between the roll and the support pad throughout the full range of vertical motion of the clam shell linkage.

6. The transfer table according to claim 5 wherein the second end region of the positioning member includes a slot slidably connected to the connecting member of the pivot member to maintain the support pad in one position during the full range of vertical movement of the arms.

* * * * *